US012453411B2

(12) United States Patent
Lin

(10) Patent No.: US 12,453,411 B2
(45) Date of Patent: Oct. 28, 2025

(54) FOLDING BEVERAGE ICE COOLER TABLE

(71) Applicant: Dongguan Shichang Metals Factory Ltd., DongGuan (CN)

(72) Inventor: Chen-Kang Lin, DongGuan (CN)

(73) Assignee: Dongguan Shichang Metals Factory Ltd., DongGuan (CN)

( * ) Notice: Subject to any disclaimer, the term of this patent is extended or adjusted under 35 U.S.C. 154(b) by 133 days.

(21) Appl. No.: 18/483,546

(22) Filed: Oct. 10, 2023

(65) Prior Publication Data

US 2025/0089886 A1 Mar. 20, 2025

(30) Foreign Application Priority Data

Sep. 18, 2023 (CN) ..... 202311208927.X

(51) Int. Cl.

*A47B 3/091* (2006.01)
*A47B 13/08* (2006.01)
*A47B 37/00* (2006.01)

(52) U.S. Cl.

CPC ..... *A47B 3/0912* (2013.01); *A47B 13/083* (2013.01); *A47B 37/00* (2013.01)

(58) Field of Classification Search

CPC ... A47B 3/0911; A47B 3/0912; A47B 13/083; A47B 37/00; A47B 31/02

See application file for complete search history.

(56) References Cited

U.S. PATENT DOCUMENTS 4,574,594 A * 3/1986 Simmons ..... A47B 3/0818 62/457.1
4,706,817 A * 11/1987 Greathouse ..... A47J 47/14 D34/24
5,060,580 A * 10/1991 Shaw ..... A47B 3/083 108/33

(Continued)

FOREIGN PATENT DOCUMENTS

CN 103239041 A 8/2013

OTHER PUBLICATIONS

Amazon.com—7Penn Outdoor Bar Cooler Table with Skirt (published Feb. 27, 2023)—https://www.amazon.com/7Penn-Outdoor-Cooler-Table-Skirt/dp/B0BWP21YKV?th=1.

(Continued)

*Primary Examiner* — Daniel J Rohrhoff
(74) *Attorney, Agent, or Firm* — Luedeka Neely, P.C.

(57) ABSTRACT

A cooler table includes a blow-molded tabletop that forms a tray for holding ice, and two collapsible leg assemblies for supporting the tabletop. The tabletop has an upper surface, a perimeter lip, and a lower surface. The upper surface slopes downward from its outer edges to accommodate flow of liquid toward an upper drain aperture as the ice melts. The lower surface of the tabletop includes an outer perimeter portion, a central portion, a first end portion, a second end portion, a first side portion, and a second side portion. The outer perimeter portion includes a first side perimeter portion, a second side perimeter portion, a first end perimeter portion, and a second end perimeter portion. The central (Continued)

portion is disposed between the first and second side perimeter portions and between the first and second end perimeter portions. The central portion is spaced apart from the upper surface and has a lower drain aperture that is aligned with the upper drain aperture.

12 Claims, 9 Drawing Sheets

(56) References Cited

U.S. PATENT DOCUMENTS

| | | | | |
|---|---|---|---|---|
| 5,727,857 | A * | 3/1998 | Smith | A47F 3/0404 312/351.3 |
| 6,612,127 | B2 | 9/2003 | Simmons | |
| 6,832,492 | B1 * | 12/2004 | Kunkel | F25D 3/06 62/458 |
| 8,104,152 | B2 * | 1/2012 | Spiers | A61G 17/047 27/27 |
| 8,188,410 | B2 | 5/2012 | Dean et al. | |
| 8,490,551 | B1 * | 7/2013 | Wagner | F25D 3/06 312/229 |
| 9,247,807 | B1 | 2/2016 | Sanchez | |
| 10,077,934 | B1 * | 9/2018 | Dizon | F25D 25/005 |
| 10,117,513 | B1 * | 11/2018 | Tolentino | A47B 31/04 |
| 10,499,731 | B2 * | 12/2019 | Flow | B07B 13/003 |
| 2003/0121277 | A1 * | 7/2003 | Simmons | A47F 3/0439 62/457.2 |
| 2003/0233968 | A1 * | 12/2003 | Strong | A47B 13/003 108/132 |
| 2005/0109244 | A1 | 5/2005 | Pote | |
| 2005/0109245 | A1 * | 5/2005 | Pote | A47B 31/02 108/25 |
| 2009/0056595 | A1 * | 3/2009 | Dean | A47B 3/0911 108/24 |
| 2013/0186306 | A1 * | 7/2013 | Thornley | A47B 33/00 108/24 |

OTHER PUBLICATIONS

European Patent Office, Extended European Search Report for Application No. 24200188.1-1015, dated Jan. 31, 2025.

* cited by examiner (Section A-A)

(Section B-B)

Section U-U

FOLDING BEVERAGE ICE COOLER TABLE

FIELD

This invention relates to the field of tables having collapsible legs. More particularly, this invention relates to a table having collapsible legs and a blow-molded tabletop that forms a tray for holding ice with chilled food or beverages.

BACKGROUND

Cooler tables are used for serving food or beverages, such as at social events, while keeping the items chilled. Some such tables have legs that collapse against their lower surface to provide for ease of transport and storage when not in use. Prior cooler table designs have incorporated solid tabletops, such as the table described in U.S. Pat. No. 6,832,492. Due to their solid structures, these tables are heavy and therefore cumbersome to transport and set up. Also, most solid structures do not provide adequate thermal insulation properties that are needed for cooler table applications. The lack of adequate insulation also leads to excessive moisture condensation on outside surfaces of the tabletop.

What is needed, therefore, is a cooler table having a light-weight structure to provide for easier storage, transportation and set up, and having a hollow tabletop structure to achieve better thermal insulation performance.

SUMMARY

The above and other needs are met by a cooler table that is convenient to transport and set up, provides for service of large quantities of chilled beverages, and has no moisture condensation on outside surfaces of the tabletop when in use. Preferred embodiments of the cooler table include a blow-molded tabletop, a first collapsible leg assembly, and a second collapsible leg assembly. The blow-molded tabletop has an upper surface, a perimeter lip, and a lower surface. The upper surface has outer edges and an upper drain aperture centrally disposed between the outer edges. The upper surface slopes downward from the outer edges toward the upper drain aperture to accommodate flow of liquid from the outer edges toward the upper drain aperture. The perimeter lip has inner walls extending upward from the outer edges of the upper surface of the tabletop and outer walls spaced apart from the inner walls. The outer walls include a first side outer wall, a second side outer wall, a first end outer wall, and a second end outer wall.

The lower surface of the tabletop is disposed below the upper surface and spans between the outer walls of the perimeter lip. The lower surface includes an outer perimeter portion, a central portion, a first end portion, a second end portion, a first side portion, and a second side portion. The outer perimeter portion is disposed adjacent to the outer walls of the perimeter lip. The outer perimeter portion includes a first side perimeter portion disposed adjacent to the first side outer wall of the perimeter lip, a second side perimeter portion disposed adjacent to the second side outer wall of the perimeter lip, a first end perimeter portion disposed adjacent to the first end outer wall of the perimeter lip, and a second end perimeter portion disposed adjacent to the second end outer wall of the perimeter lip.

The central portion is disposed between the first and second side perimeter portions and between the first and second end perimeter portions. The central portion is spaced apart from the upper surface by a first distance and has a lower drain aperture that is aligned with the upper drain aperture. The first end portion, which is disposed between the central portion and the first end perimeter portion, is spaced apart from the upper surface by a second distance. The second end portion, which is disposed between the central portion and the second end perimeter portion, is spaced apart from the upper surface by the second distance. The first side portion, which is disposed between the central portion and the first side perimeter portion, is spaced apart from the upper surface by a third distance. The second side portion, which is disposed between the central portion and the second side perimeter portion, is spaced apart from the upper surface by the third distance. In a preferred embodiment, the first distance has a largest value that is greater than the largest value of the second distance, and the second distance has a largest value that is greater than the largest value of the third distance.

The first collapsible leg assembly is operable to move between a collapsed position in which the first collapsible leg assembly is disposed against the lower surface of the tabletop and an extended position in which the first collapsible leg assembly extends outward from the lower surface of the tabletop. The first collapsible leg assembly comprises a first attachment bar, a first cross tube, a first pair of legs, and a first articulated support bracket assembly. The first attachment bar is secured to the lower surface of the tabletop within the central portion. The first cross tube is rotatably attached to the lower surface of the tabletop and disposed adjacent and parallel to the first end perimeter portion. The first pair of legs is attached to and extends from the first cross tube. The first articulated support bracket assembly has a first end rotatably attached to the first pair of legs and a second end rotatably attached to the first attachment bar. When the first collapsible leg assembly is in the collapsed position, the first articulating support bracket assembly is folded against the first end portion of the tabletop, one leg of the first pair of legs is disposed against the first side portion of the lower surface of the tabletop, and another leg of the first pair of legs is disposed against the second side portion of the lower surface of the tabletop.

The second collapsible leg assembly is operable to move between a collapsed position in which the second collapsible leg assembly is disposed against the lower surface of the tabletop and an extended position in which the second collapsible leg assembly extends outward from the lower surface of the tabletop. The second collapsible leg assembly comprises a second attachment bar, a second cross tube, a second pair of legs, and a second articulated support bracket assembly. The second attachment bar is secured to the lower surface of the tabletop within the central portion. The second cross tube is rotatably attached to the lower surface of the tabletop and disposed adjacent and parallel to the second end perimeter portion. The second pair of legs is attached to and extends from the second cross tube. The second articulated support bracket assembly has a first end rotatably attached to the second pair of legs and a second end rotatably attached to the second attachment bar. When the second collapsible leg assembly is in the collapsed position, the second articulating support bracket assembly is folded against the second end portion of the tabletop, one leg of the second pair of legs is disposed against the first side portion of the lower surface of the tabletop, and another leg of the second pair of legs is disposed against the second side portion of the lower surface of the tabletop.

In some preferred embodiments, the cooler table includes retainer clips that are integrally molded into the lower surface of the tabletop for rotatably securing the first and second cross tubes to the lower surface. The retainer clips include two or more first retainer clips for rotatably securing the first cross tube between the first end perimeter portion and the first end portion, and two or more second retainer clips for rotatably securing the second cross tube between the second end perimeter portion and the second end portion.

In some preferred embodiments, each of the first retainer clips includes a first section disposed within the first end perimeter portion, and a second section disposed within the first end portion, and each of the second retainer clips comprises a first section disposed within the second end perimeter portion, and a second section disposed within the second end portion.

In some preferred embodiments, the cooler table includes a plurality of end perimeter depressions formed in the lower surface of the tabletop. The end perimeter depressions include a plurality of first end perimeter depressions distributed along the first end perimeter portion that are configured to provide structural support between the lower surface of the tabletop and the upper surface of the tabletop, wherein at least a portion of each of the two or more first retainer clips is disposed between two of the first end perimeter depressions. The end perimeter depressions also include a plurality of second end perimeter depressions distributed along the second end perimeter portion that are configured to provide structural support between the lower surface of the tabletop and the upper surface of the tabletop, wherein at least a portion of each of the two or more second retainer clips is disposed between two of the second end perimeter depressions.

In some preferred embodiments, the cooler table includes an integrally molded tubular section that extends through the tabletop to fluidly connect the upper and lower drain apertures, so that liquid can enter the upper drain aperture, flow through the tubular section, and exit the lower drain aperture.

In some preferred embodiments, the cooler table includes a plurality of first end depressions, a plurality of second end depressions, a plurality of first side depressions, and a plurality of second side depressions, all of which provide structural support between the lower surface and the upper surface of the tabletop. Each of the first end depressions, which are formed in the first end portion of the lower surface of the tabletop, occupies an area A1 in the lower surface and has a height H1 measured between the lower surface and the upper surface of the tabletop. Each of the second end depressions, which are formed in the second end portion of the lower surface of the tabletop, occupies the area A1 in the lower surface and has the height H1 measured between the lower surface and the upper surface of the tabletop. Each of the first side depressions, which are formed in the first side portion of the lower surface of the tabletop, occupies an area A2 in the lower surface and has a height H2 measured between the lower surface and the upper surface of the tabletop. Each of the second side depressions, which are formed in the second side portion of the lower surface of the tabletop, occupies the area A2 in the lower surface and has the height H2 measured between the lower surface and the upper surface of the tabletop. In a preferred embodiment, the area A1 is greater than the area A2, and the height H1 is greater than the height H2.

In some preferred embodiments, the first and second side portions of the lower surface of the tabletop are each sufficiently wide to accommodate the first pair of legs and the second pair of legs in a side-by-side arrangement.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

FIGS. 1A, 1B, 2A and 2B depict a cooler table 10 used for serving food or beverages, such as at social events. The tabletop 12, which is preferably made of plastic formed by blow molding, comprises a tray for holding a bed of ice in which food or beverage items stay chilled. Due to the blow-molding process, the tabletop 12 has a double-walled tray structure that provides thermal insulation on the bottom and sides of the tray.

Figure 1A:
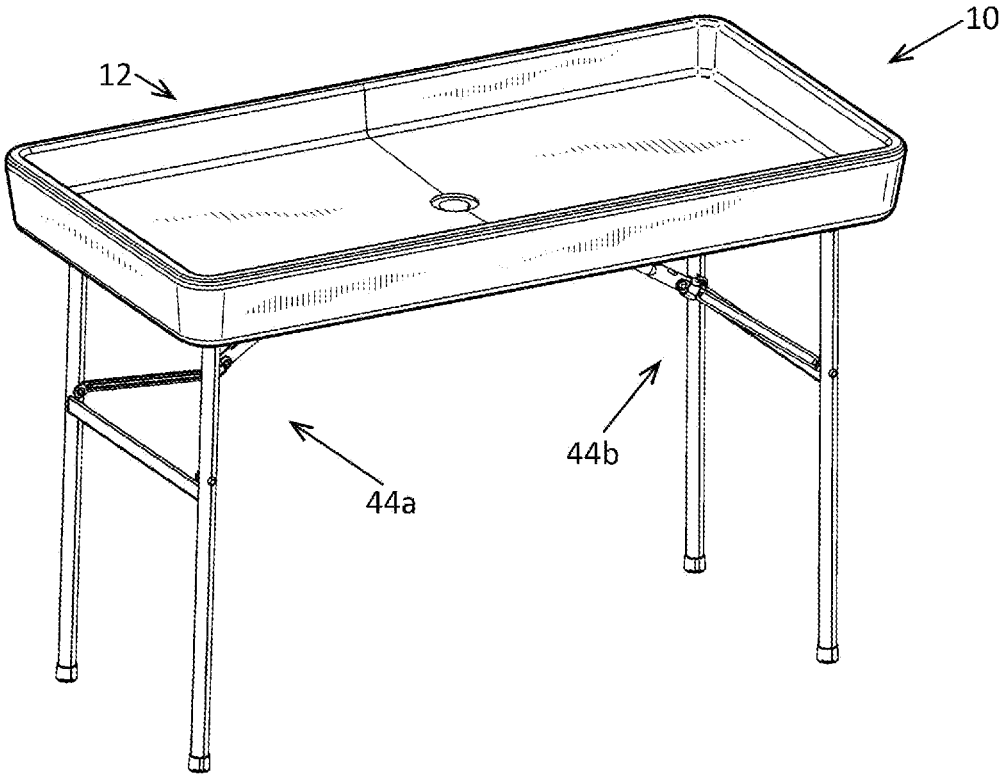
FIG. 1A depicts a top perspective view of a cooler table with legs extended according to an embodiment of the invention.
Figure 1B:
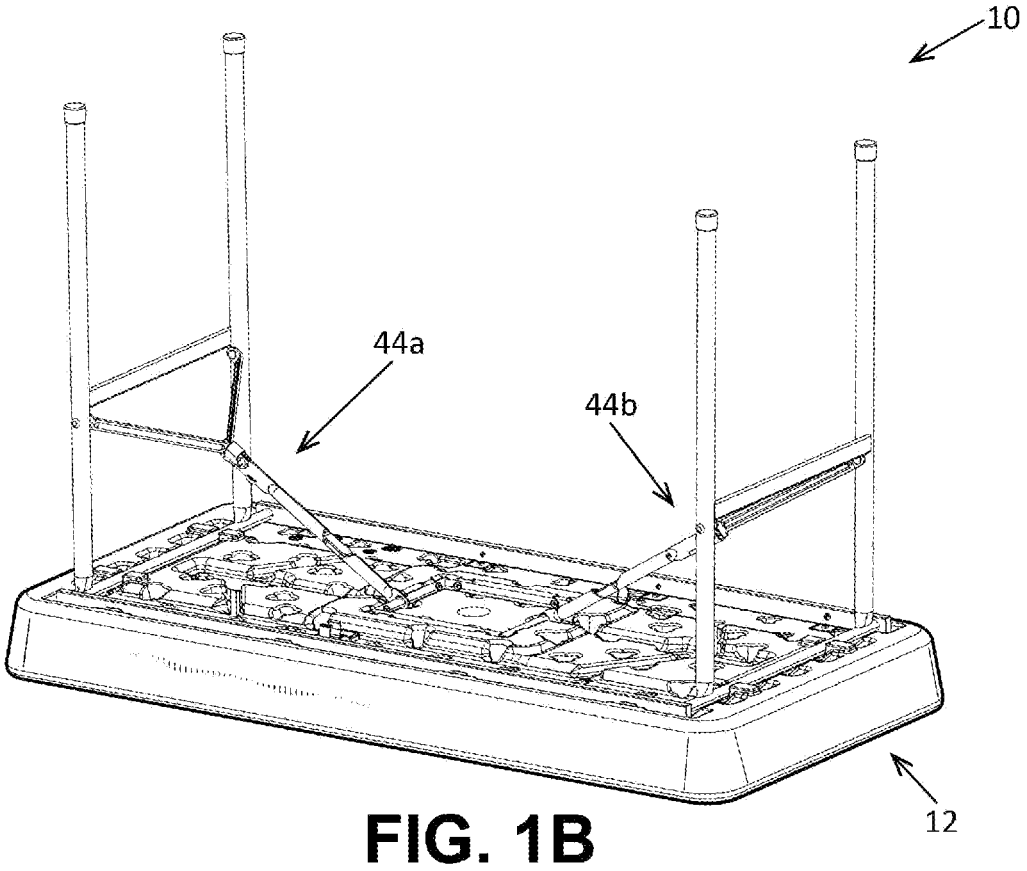
FIG. 1B depicts a bottom perspective view of a cooler table with legs extended according to an embodiment of the invention.
Figure 2A:
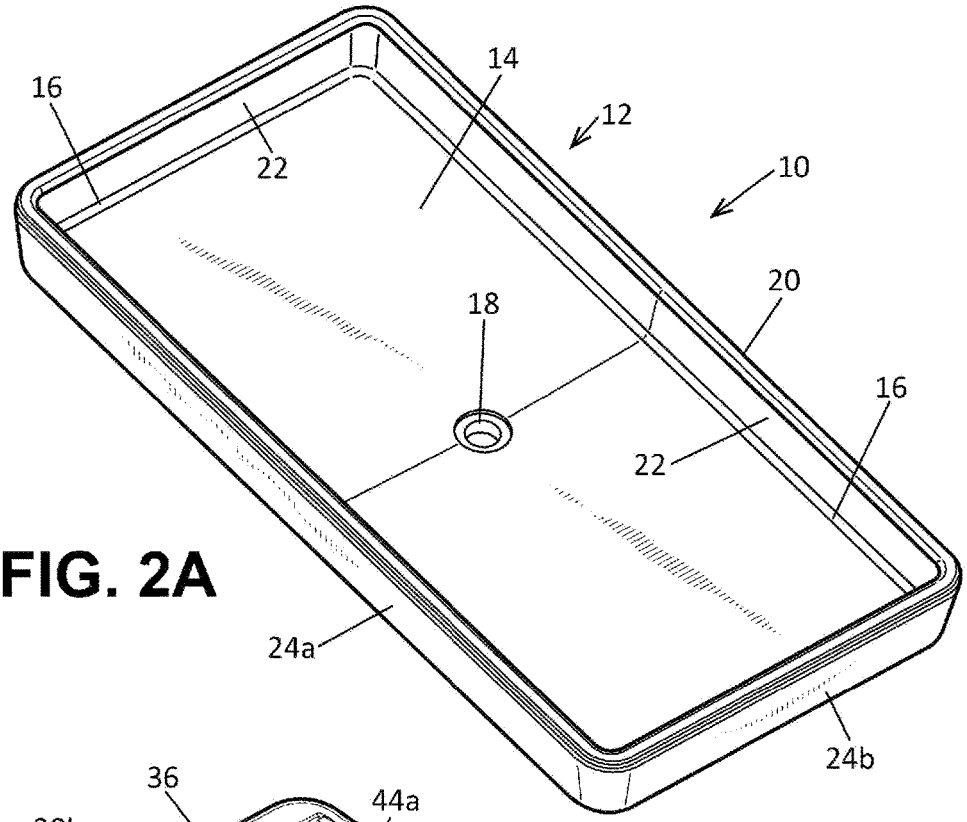
FIG. 2A depicts a top perspective view of a cooler table with legs collapsed according to an embodiment of the invention.
Figure 2B:
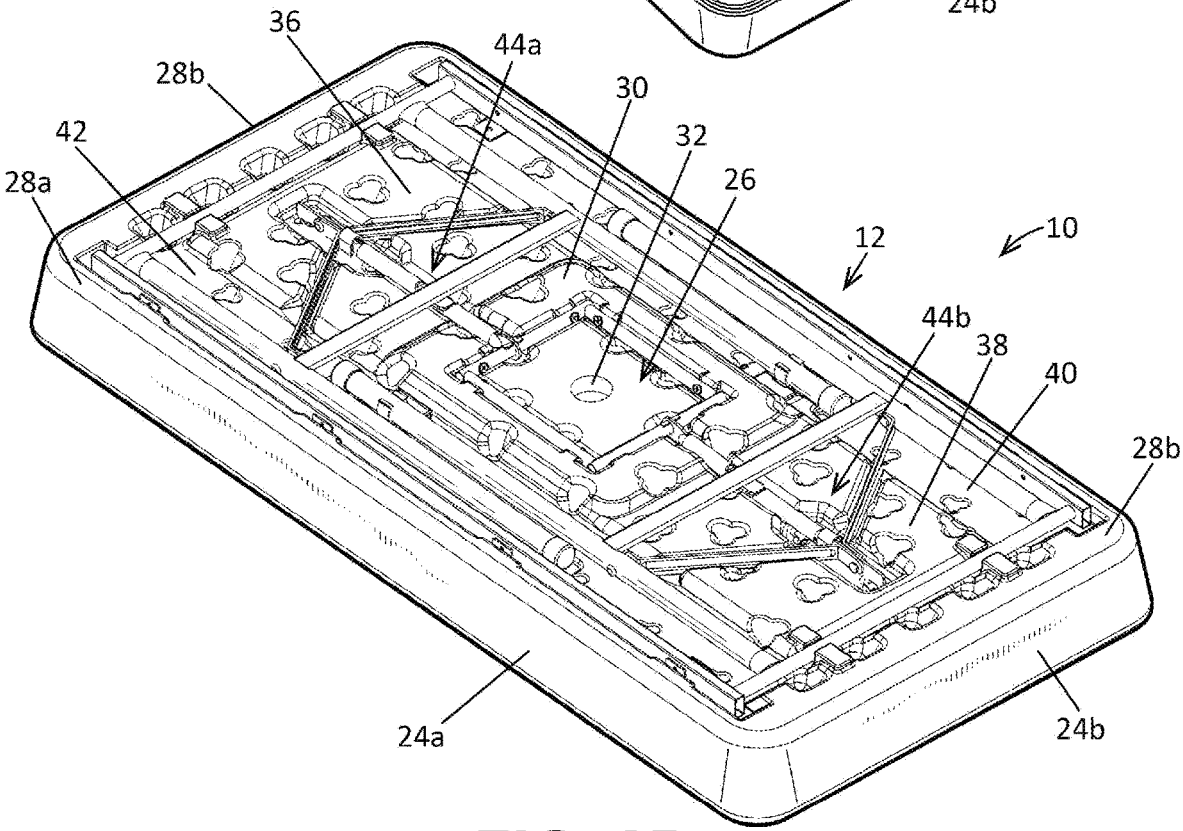
FIG. 2B depicts a bottom perspective view of a cooler table with legs collapsed according to an embodiment of the invention.

As described in more detail below, the table 10 preferably has legs 50*a* and 50*b* that collapse against the underside of the tabletop 12 to make the structure easier to transport and store. FIGS. 1A and 1B depict the table 10 in a use configuration in which the legs are extended. FIGS. 2A and 2B depict the table 10 in a storage configuration in which the legs are collapsed.

Descriptions of embodiments of the table 10 provided herein refer to various surfaces in the structure of the tabletop 12. As the term is used herein, a "surface" refers to a wall of a molded structure having a thickness that is relatively small compared to the length and width of the structure. For example, the thickness of a wall of a blow-molded structure may be between about 1.50 mm and 4.00 mm, whereas the surface may span a distance that is on the order of 400 times the thickness. Thus, unless specifically defined herein as an inner surface or an outer surface, the word "surface" is not limited to the inside or the outside of a double-wall blow-molded structure but refers generally to a wall of the double-wall structure.

The tabletop 12 includes an upper surface 14 having outer edges 16, and a perimeter lip 20 having inner walls 22 that extend upward from the outer edges 16. The perimeter lip 20 has outer walls that are spaced apart from the inner walls 22, including first and second side outer walls 24*a* and first and second end outer walls 24*b*. In the description provided herein, the first and second side outer walls 24*a* define the length of the tabletop 12, and the first and second end outer walls 24*b* define the width of the tabletop 12. An upper drain aperture 18 is centrally disposed between the outer edges 16 of the tabletop 12. In a preferred embodiment, the upper surface 14 slopes downward from the outer edges 16 toward the upper drain aperture 18 to accommodate flow of water from the outer edges 16 toward the upper drain aperture 18 as ice melts.

In preferred embodiments, the thickness of the material of the upper surface 14 varies from about 3.10 mm to about 3.70 mm, and the thickness of the material of the lip 20 varies from about 2.50 mm to about 3.70 mm.

The tabletop 12 includes a lower surface 26 that spans the distance between the outer walls 24*a* and 24*b* of the perimeter lip 20. In a preferred embodiment, the lower surface 26 includes outer perimeter portions 28*a*-28*b*, a central portion 30, a first end portion 36, a second end portion 38, a first side portion 40 and a second side portion 42. The outer perimeter portions, which are disposed adjacent to the outer walls 24*a*-24*b* of the perimeter lip 20, comprise first and second side perimeter portions 28*a* disposed opposite each other, and first and second end perimeter portions 28*b* disposed opposite each other. The first side perimeter portion 28*a* is disposed adjacent to the first side outer wall 24*a* of the perimeter lip 20, and the second side perimeter portion 28*a* is disposed adjacent to the second side outer wall 24*a* of the perimeter lip 20. The first end perimeter portion 28*b* is disposed adjacent to the first end outer wall 24*b* of the perimeter lip 20, and the second end perimeter portion 28*b* is disposed adjacent to the second end outer wall 24*b* of the perimeter lip 20.

In preferred embodiments, the thickness of the material of the lower surface 26 varies from about 2.50 mm to about 4.00 mm, and the thickness of the material of the outer perimeter portions 28*a*-28*b* varies from about 1.50 mm to about 2.60 mm.

The central portion 30 of the lower surface 26 is disposed between the first and second side portions 40 and 42 and between the first and second end portions 36 and 38 and is spaced apart from the upper surface 14 by a distance D1. The central portion 30 has a lower drain aperture 32 that is aligned with the upper drain aperture 18. An integrally molded tubular section 34 extends through the tabletop 12 to fluidly connect the upper and lower drain apertures 18 and 32, so that liquid can enter the upper drain aperture 18, flow through the tubular section 34, and exit from the lower drain aperture 32.

The first end portion 36 of the lower surface 26 is disposed between the central portion 30 and the first end perimeter portion 28*b* and is spaced apart from the upper surface 14 by a distance D2. The second end portion 38 of the lower surface 26 is disposed between the central portion 30 and the second end perimeter portion 28*b* and is spaced apart from the upper surface 14 by the distance D2.

The first side portion 40 of the lower surface 26 is disposed between the central portion 30 and the first side perimeter portion 28*a* and is spaced apart from the upper surface 14 by a distance D3. The second side portion 42 of the lower surface 26 is disposed between the central portion 30 and the second side perimeter portion 28*a* and is spaced apart from the upper surface 14 by the distance D3.

Figure 4A:
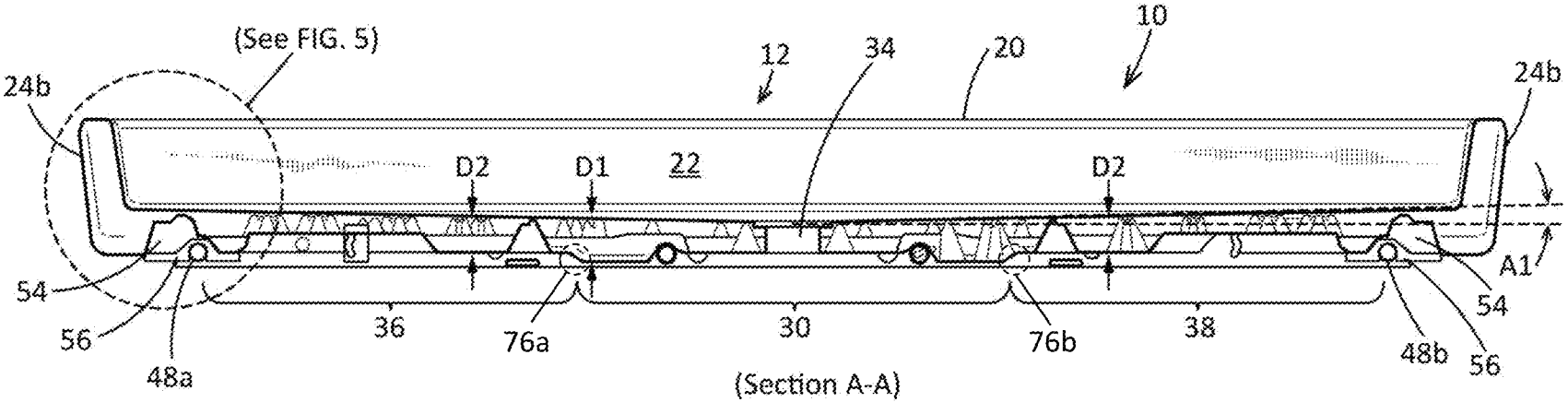
FIG. 4A depicts a lengthwise cross-section view of a cooler table according to an embodiment of the invention.
Figure 4B:
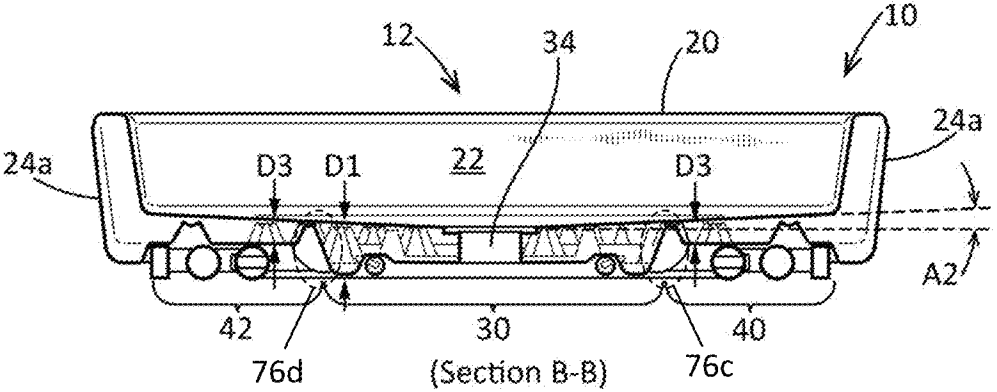
FIG. 4B depicts a widthwise cross-section view of a cooler table according to an embodiment of the invention.

In a preferred embodiment depicted in FIGS. 4A and 4B, there are first and second stepped transitions 76*a* and 76*b* in the distance between the upper surface 14 and the lower surface 26 where the central portion 30 meets the first and second end portions 36 and 38 of the lower surface 26 (i.e., stepped transitions from D1 to D2). There are also stepped transitions 76*c* and 76*d* in the distance between the upper surface 14 and the lower surface 26 where the central portion 30 meets the first and second side portions 40 and 42 of the lower surface 26 (i.e., stepped transitions from D1 to D3). Further, although the distance D1 between the upper surface 14 and the central portion 30 of the lower surface 26 varies over a range, and the distance D2 between upper surface 14 and the first and second end portions 36 and 38 of the lower surface 26 varies over a range, the largest value of the distance D1 is greater than the largest value of the distance D2. Also, although the distance D3 between the upper surface 14 and the first and second side perimeter portions 40 and 42 of the lower surface 26 varies over a range, the largest value of the distance D1 is greater than the largest value of the distance D3. This variation in distances that define the overall height in the various portions of the tabletop 12 across its length and width—smaller height toward the edges and larger height toward the center—accommodates the downward slope of the upper surface 14 from its outer edges 16 toward the drain aperture 18. It also provides more space near the side edges to accommodate the legs 50*a* and 50*b* and more space near the end edges to accommodate the leg support brackets when the legs are in the collapsed position.

The table 10 includes first and second collapsible leg assemblies 44*a* and 44*b* that are operable to move between a collapsed position in which the leg assemblies are disposed against the lower surface 26 of the tabletop 12 and an extended position in which the leg assemblies extend outward from the lower surface 26. The first collapsible leg assembly 44*a* includes a first attachment bar 46*a* that is attached to the lower surface 26 of the tabletop 12 within the central portion 30. In a preferred embodiment, the first attachment bar 46*a* is secured to the lower surface 26 with fasteners, such as screws. A first cross tube 48*a* is rotatably attached to the lower surface 26 adjacent and parallel to the outer edge of the first end perimeter portion 28*b*. The opposing ends of the first cross tube 48*a* are rotatably received in apertures in opposing side rails 64 that are attached to the first side perimeter portions 28*a* of the lower surface 26. The first cross tube 48*a* is also rotatably secured to the lower surface 26 by a pair of retainer clips 56 that are described in more detail hereinafter.

The first collapsible leg assembly 44*a* includes a first pair of legs 50*a* that are attached to and extend from the first cross tube 48*a*, and a first articulated support bracket assembly 52*a* having a first end that is rotatably attached to the first pair of legs 50*a* and a second end that is rotatably attached to the first attachment bar 46*a*. The first articulated support bracket assembly 52*a* includes an inner bracket portion 66*a* and an outer bracket portion 68*a*. The inner bracket portion 66*a* is rotatably attached at its distal end to the first attachment bar 46*a* and at its proximal end to the inner end of the outer bracket portion 68*a*. The outer ends of the outer bracket portion 68*a* are rotatably attached to the first pair of legs 50*a*.

As shown in FIGS. 2B, 3B, 4A and 4B, when the first collapsible leg assembly 44*a* is in the collapsed position, the first articulating support bracket assembly 52*a* collapses down against the first end portion 36 of the lower surface 26 of the tabletop 12, with one leg 50*a* disposed against the first side portion 40 of the lower surface 26 and the other leg 50*a* disposed against the second side portion 42 of the lower surface 26.

Similarly, the second collapsible leg assembly 44*b* includes a second attachment bar 46*b* that is attached to the lower surface 26 of the tabletop 12 within the central portion 30. In a preferred embodiment, the second attachment bar 46*b* is secured to the lower surface 26 with fasteners, such as screws. A second cross tube 48*b* is rotatably attached to the lower surface 26 adjacent and parallel to the outer edge of the second end perimeter portion 28*b*. The opposing ends of the second cross tube 48*b* are rotatably received in apertures in the opposing side rails 64. The second cross tube 48*b* is also rotatably secured to the lower surface 26 by a pair of retainer clips 56 that are described in more detail hereinafter.

The second collapsible leg assembly 44*b* includes a second pair of legs 50*b* that are attached to and extend from the second cross tube 48*b*, and a second articulated support bracket assembly 52*b* having a first end that is rotatably attached to the second pair of legs 50*b* and a second end that is rotatably attached to the second attachment bar 46*b*. The second articulated support bracket assembly 52*b* includes an inner bracket portion 66*b* and an outer bracket portion 68*b*. The inner bracket portion 66*b* is rotatably attached at its distal end to the second attachment bar 46*b* and at its proximal end to the inner end of the outer bracket portion 68*b*. The outer ends of the outer bracket portion 68*b* are rotatably attached to the second pair of legs 50*b*.

As shown in FIGS. 2B, 3B, 4A and 4B, when the second collapsible leg assembly 44*b* is in the collapsed position, the second articulating support bracket assembly 52*b* collapses down against the second end portion 38 of the lower surface 26 of the tabletop 12, with one leg 50*b* disposed against the first side portion 40 of the lower surface 26 and the other leg 50*b* disposed against the second side portion 42 of the lower surface 26. It should be noted that the first and second side portions 40 and 42 are sufficiently wide to accommodate the legs 50*a* and 50*b* in a side-by-side arrangement.

Figure 5:
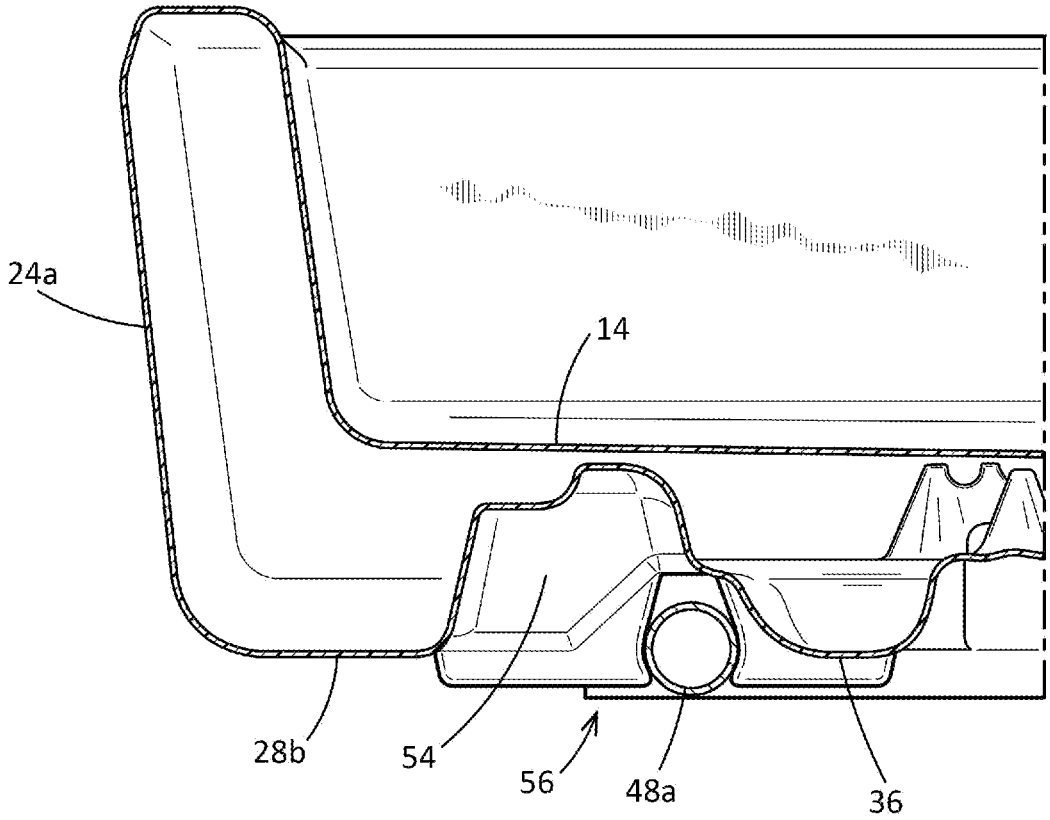
FIG. 5 depicts a cross-section view of a retainer clip in a lower surface of a blow-molded tabletop of a cooler table according to an embodiment of the invention.
Figure 6:
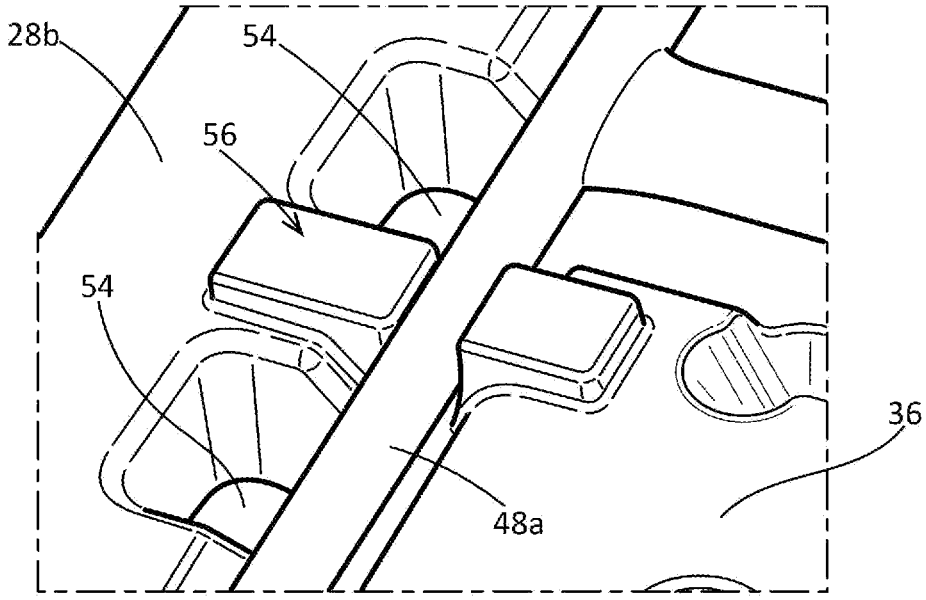
FIG. 6 depicts a perspective view of a retainer clip in a lower surface of a blow-molded tabletop of a cooler table according to an embodiment of the invention.

As shown in FIGS. 4A, 5 and 6, a preferred embodiment of the tabletop 12 includes retainer clips 56 that are integrally molded into the lower surface 26. Each retainer clip 56 comprises two opposing sections disposed to either side of a cross tube 48*a*-48*b*. One of the sections of each clip 56 is integrally molded as part of the first end perimeter portion 28*b* and the other section is integrally molded as part of the first end portion 36. At the other end of the tabletop 12, one of the sections of each clip 56 is integrally molded as part of the second end perimeter portion 28*b* and the other section is integrally molded as part of the second end portion 38. In a preferred embodiment, two retainer clips 56 are provided at each end of the tabletop 12 to rotatably secure the first cross tube 48*a* between the first end perimeter portion 28*b* and the first end portion 36, and to rotatably secure the second cross tube 48*b* between the second end perimeter portion 28*b* and the second end portion 38. The retainer clips 56 are dimensioned so that the cross tubes 48*a*-48*b* can be pushed into a snap-fit engagement that holds the tubes 48*a*-48*b* in place while still allowing the tubes to rotate when the leg assemblies 44*a*-44*b* are moved between collapsed and extended positions.

Figure 3A:
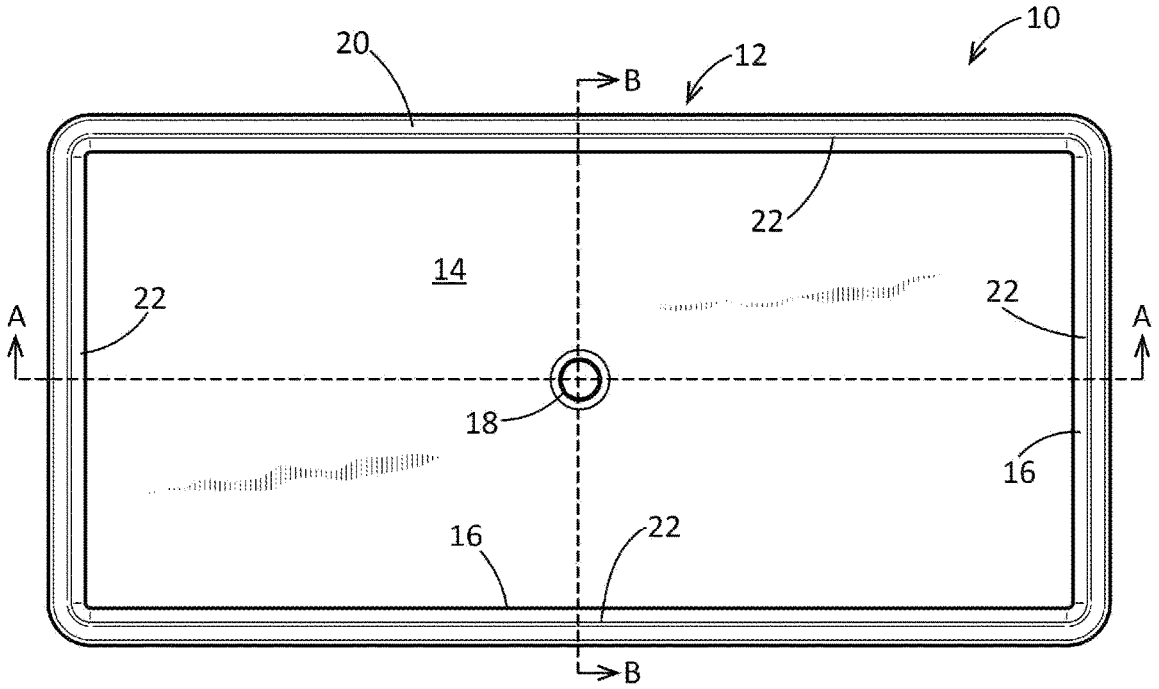
FIG. 3A depicts a top plan view of a cooler table according to an embodiment of the invention.
Figure 3B:
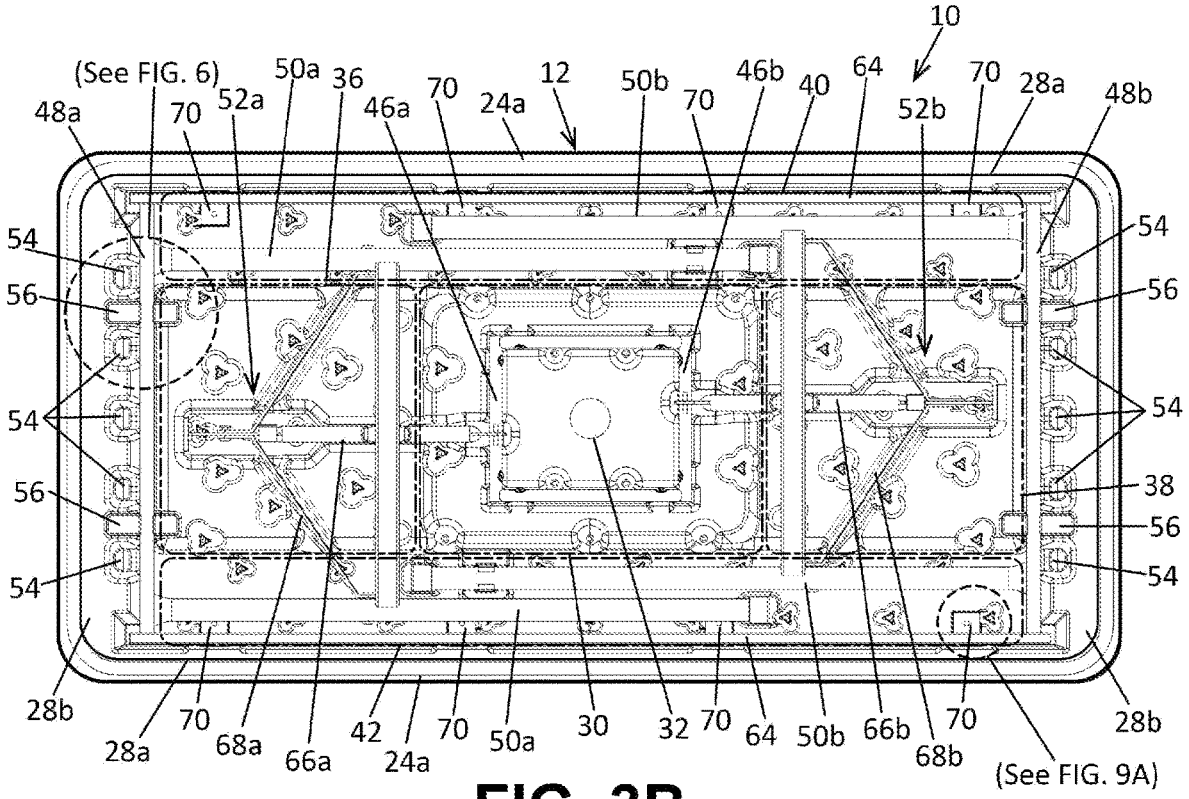
FIG. 3B depicts a bottom plan view of a cooler table with legs collapsed according to an embodiment of the invention.

As depicted in FIG. 3B, a plurality of first end perimeter depressions 54 and second end perimeter depressions 54 are distributed along the first end perimeter portion 28*b* and the second end perimeter portion 28*b* in the lower surface 26 of the tabletop 12. Details of the depressions 54 are depicted in FIGS. 5 and 6. These depressions 54 provide additional structural support between the lower surface 26 and the upper surface 14 of the tabletop within the first and second end perimeter portions 28*b* where the first and second cross tubes 48*a* and 48*b* are attached. In a preferred embodiment, five depressions 54 are provided within each end perimeter portion 28*b*.

As shown in FIG. 6, one section of each retainer clip 56 is disposed between two adjacent end perimeter depressions 54 to enhance the structural rigidity of the clip 56.

Figure 7:
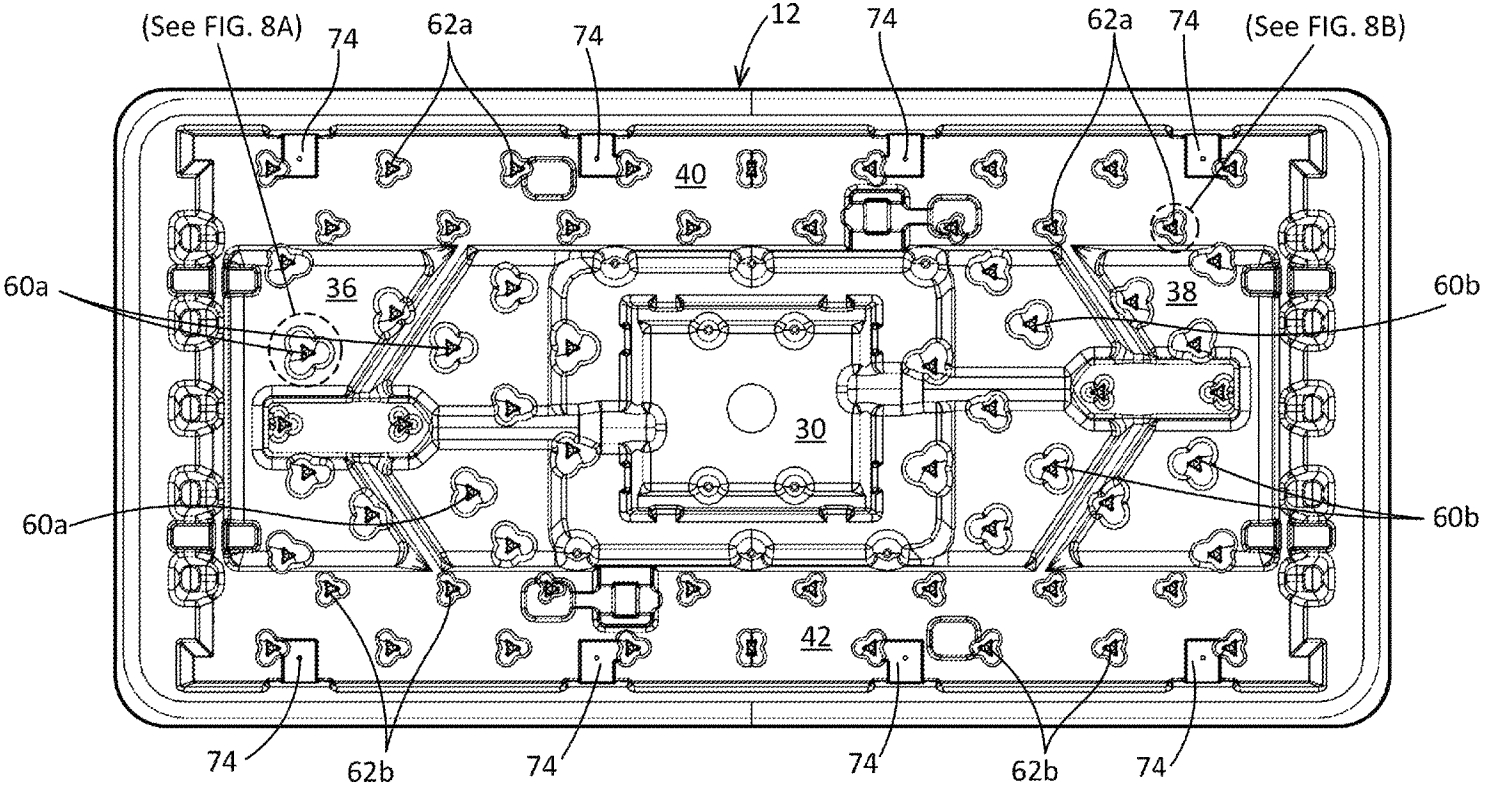
FIG. 7 depicts depressions in a lower surface of a blow-molded tabletop of a cooler table according to an embodiment of the invention.
Figure 8B:
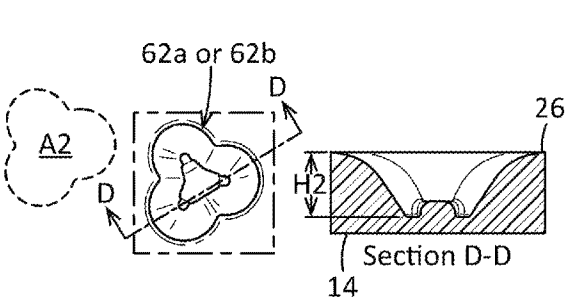
FIG. 8B depicts detailed views of a perimeter depression in a lower surface of a blow-molded tabletop of a cooler table according to an embodiment of the invention.
Figure 8A:
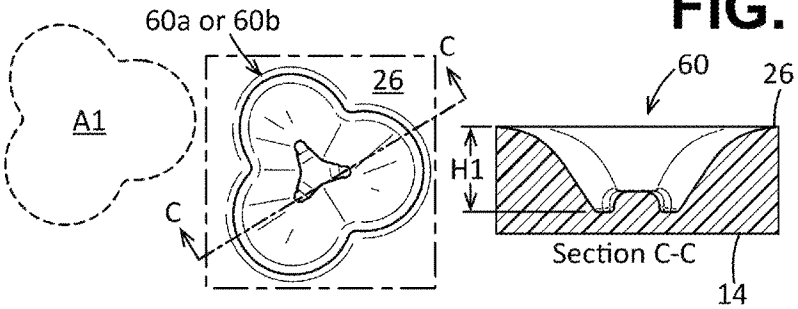
FIG. 8A depicts detail views of an end depression in a lower surface of a blow-molded tabletop of a cooler table according to an embodiment of the invention.

As shown in FIG. 7, a preferred embodiment includes depressions 60*a*-60*b* and 62*a*-62*b* that provide structural support between the lower surface 26 and the upper surface 14 of the tabletop 12. The first end depressions 60*a* are formed in the first end portion 36 of the lower surface 26 of the tabletop 12 and the second end depressions 60*b* are formed in the second end portion 38 of the lower surface 26 of the tabletop 12. As shown in FIG. 8A, each of the first end depressions 60*a* and second end depressions 60*b* occupies the area A1 in the lower surface 26 and has the height H1 measured between the lower surface 26 and the upper surface 14 of the tabletop 12.

With continued reference to FIG. 7, the first side depressions 62*a* are formed in the first side portion 40 of the lower surface 26 of the tabletop 12 and the second side depressions 62*b* are formed in the second side portion 42 of the lower surface 26 of the tabletop 12. As shown in FIG. 8B, each of the first side depressions 62*a* and second side depressions 62*b* occupies the area A2 in the lower surface 26 and has the height H2 measured between the lower surface 26 and the upper surface 14 of the tabletop 12.

In a preferred embodiment of the tabletop 12, the area A1 is greater than the area A2, and the height H1 is greater than the height H2.

Further details regarding the shape and structure of a preferred embodiment of the depressions 60*a*-60*b* and 62*a*-62*b* may be found in U.S. Pat. No. 11,147,377, the entirety of which is incorporated herein by reference.

Figure 9A:
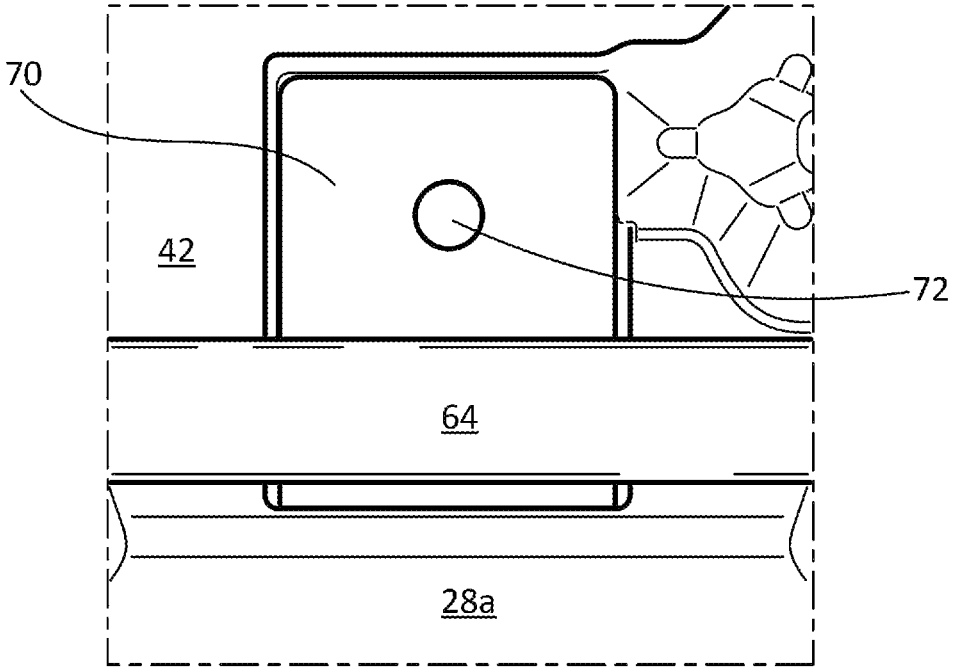
FIGS. 9A and 9B depict detail views of a bracket for attaching a side rail to a blow-molded tabletop of a cooler table according to an embodiment of the invention.
Figure 9B:
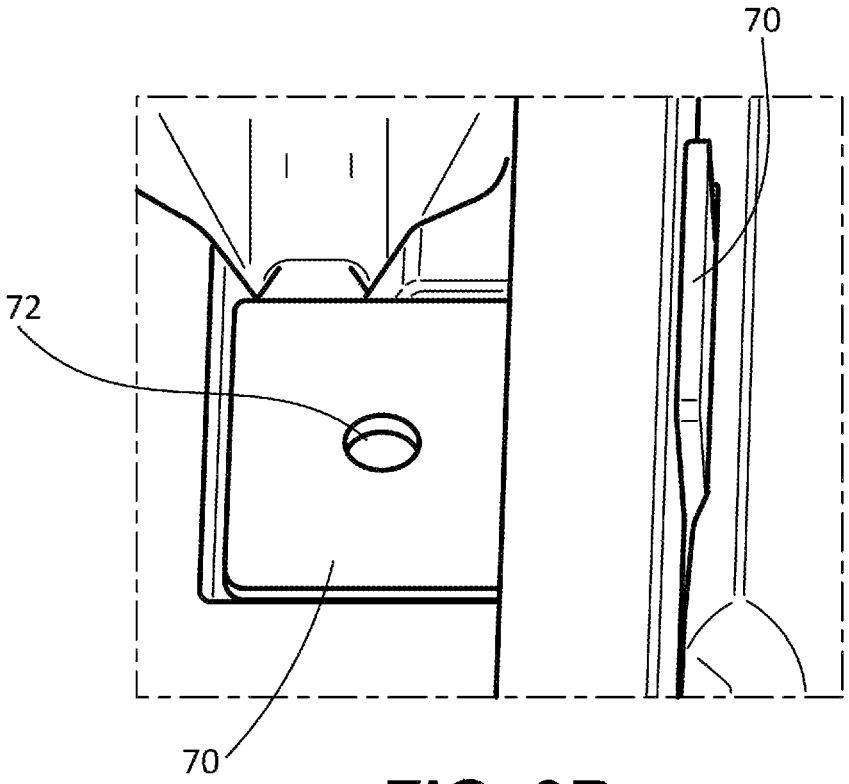

As depicted in FIGS. 3B, 9A and 9B, a preferred embodiment of the cooler table 10 includes a set of right-angle brackets 70 to enhance the strength of the attachment of the side rails 64 to the first and second end perimeter portions 28*b* of the bottom surface 26 of the tabletop 12. The brackets 70, which are preferably constructed from steel, include apertures 72 in each of their plates through which fasteners pass to secure the plates 70 and the side rail 64 to the tabletop 12. In a preferred embodiment, the brackets 70 are received in rectangular recesses 74 molded into the first and second side portions 40 and 42 of the bottom surface 26 of the tabletop 12.

Figure 10A:
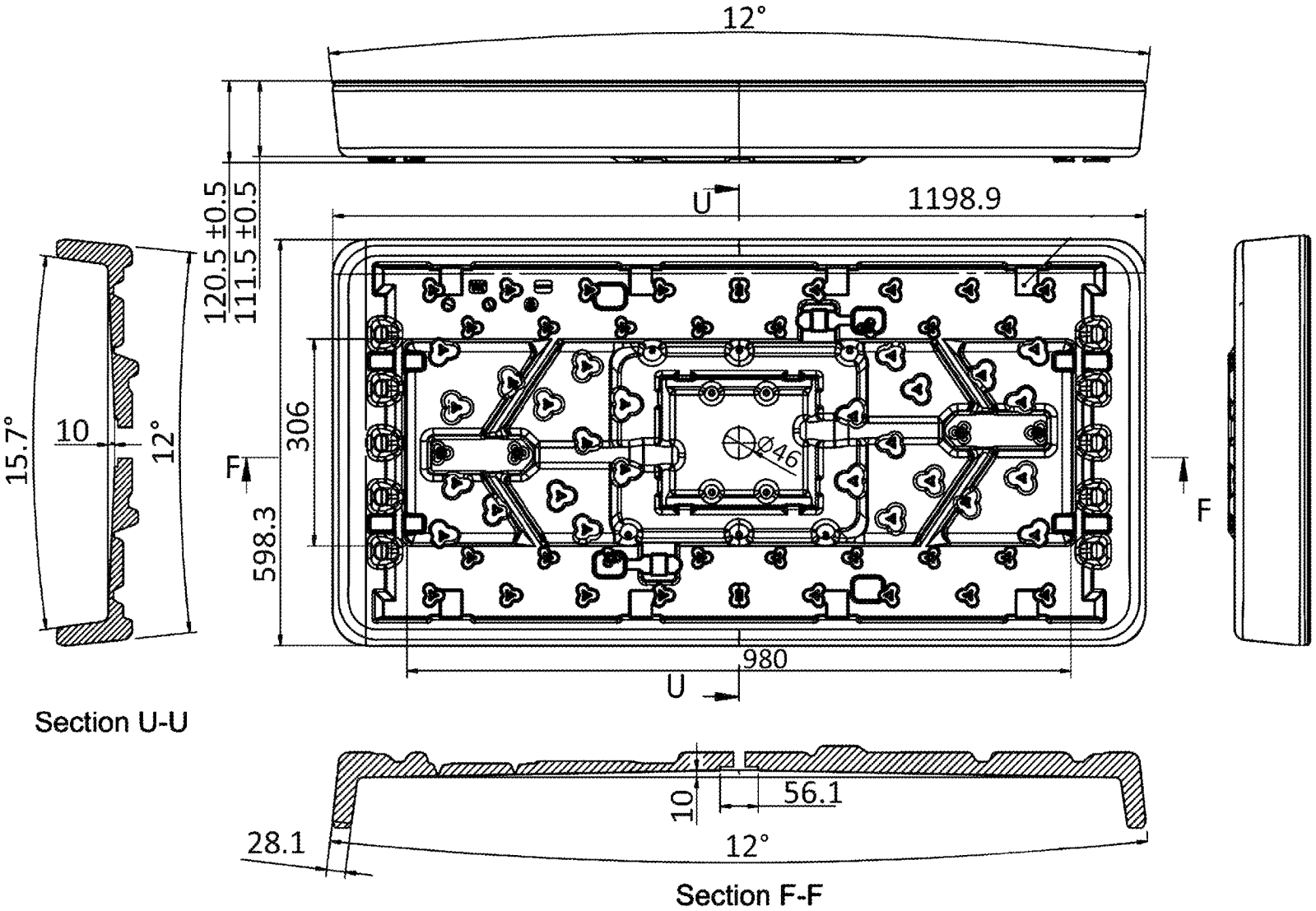
FIGS. 10A and 10B depict various dimensions of a cooler table according to embodiments of the invention.
Figure 10B:
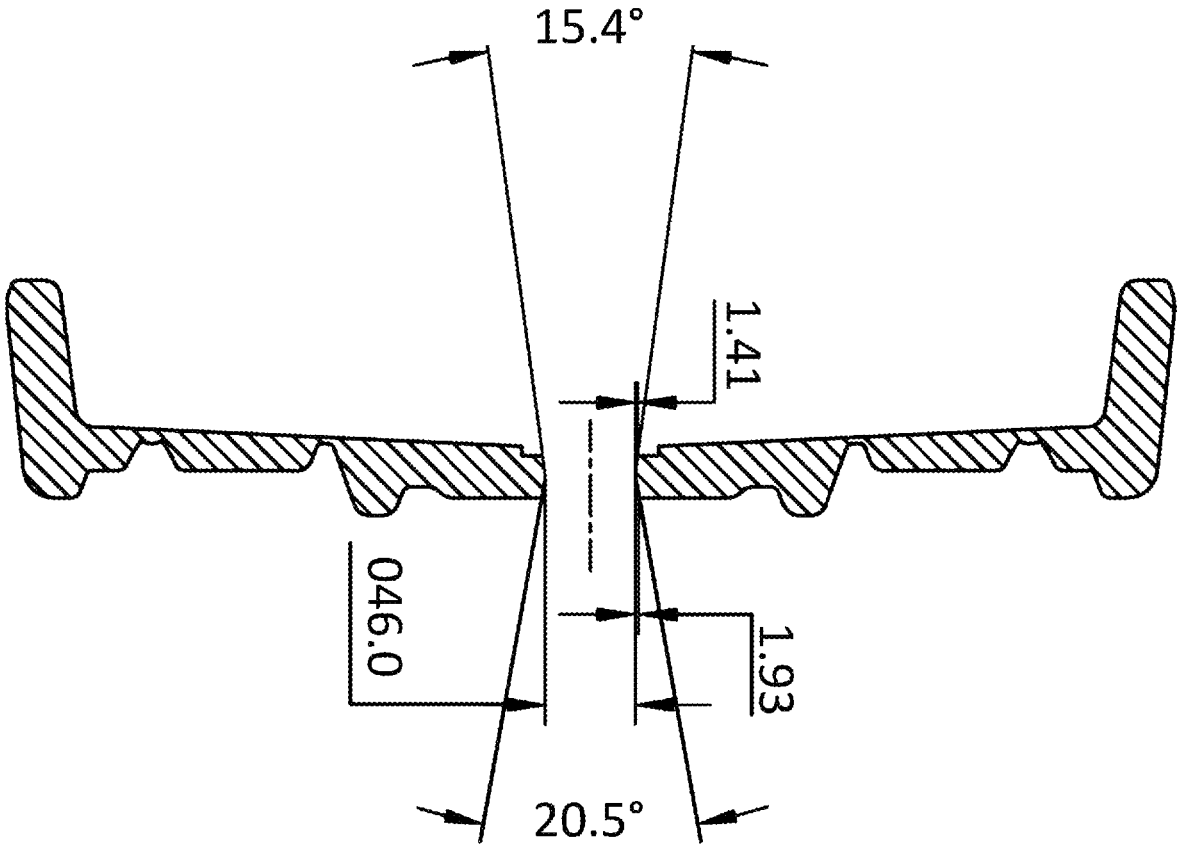

FIG. 10A depicts typical dimensions of an embodiment of the tabletop 12. Those of skill in the art will appreciate that other dimensions could be selected, and that the dimensions shown herein do not limit the scope of the invention. FIG. 10B depicts dimensions of a most preferred embodiment, in which the sidewalls of the drain aperture 18 include a chamfer at the top and bottom edges at angles of 15.4 and 20.5 degrees, respectively. This chamfered shape makes removal of the tabletop 12 from the blow molding machine easier.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A cooler table comprising:

a blow-molded tabletop comprising:

an upper surface having outer edges and an upper drain aperture centrally disposed between the outer edges, wherein the upper surface slopes downward from the outer edges toward the upper drain aperture to accommodate flow of liquid from the outer edges toward the upper drain aperture;

a perimeter lip having:

inner walls extending upward from the outer edges of the upper surface of the tabletop; and outer walls spaced apart from the inner walls, the outer walls comprising a first side outer wall, a second side outer wall, a first end outer wall, and a second end outer wall;

a lower surface disposed below the upper surface and spanning between the outer walls of the perimeter lip, the lower surface comprising:

an outer perimeter portion disposed adjacent to the outer walls of the perimeter lip, the outer perimeter portion including:

a first side perimeter portion disposed adjacent to the first side outer wall of the perimeter lip;

a second side perimeter portion disposed adjacent to the second side outer wall of the perimeter lip;

a first end perimeter portion disposed adjacent to the first end outer wall of the perimeter lip; and a second end perimeter portion disposed adjacent to the second end outer wall of the perimeter lip;

a central portion disposed between the first and second side perimeter portions and between the first and second end perimeter portions, the central portion spaced apart from the upper surface by a first distance, the central portion having a lower drain aperture that is aligned with the upper drain aperture;

a first end portion disposed between the central portion and the first end perimeter portion, the first end portion spaced apart from the upper surface by a second distance;

a second end portion disposed between the central portion and the second end perimeter portion, the second end portion spaced apart from the upper surface by the second distance;

a first side portion disposed between the central portion and the first side perimeter portion, the first side portion spaced apart from the upper surface by a third distance;

a second side portion disposed between the central portion and the second side perimeter portion, the second side portion spaced apart from the upper surface by the third distance;

a first stepped transition from the first distance to the second distance where the central portion meets the first end portion;

a second stepped transition from the first distance to the second distance where the central portion meets the second end portion;

a third stepped transition from the first distance to the third distance where the central portion meets the first side portion; and a fourth stepped transition from the first distance to the third distance where the central portion meets the second side portion, wherein the first distance has a largest value that is greater than a largest value of the second distance, and wherein the largest value of the first distance is greater than a largest value of the third distance;

a first collapsible leg assembly that is operable to move between a collapsed position in which the first collapsible leg assembly is disposed against the lower surface of the tabletop and an extended position in which the first collapsible leg assembly extends outward from the lower surface of the tabletop, the first collapsible leg assembly comprising:

a first attachment bar secured to the lower surface of the tabletop within the central portion;

a first cross tube rotatably attached to the lower surface of the tabletop and disposed adjacent and parallel to the first end perimeter portion;

a first pair of legs attached to and extending from the first cross tube;

a first articulated support bracket assembly having a first end rotatably attached to the first pair of legs and a second end rotatably attached to the first attachment bar, wherein, when the first collapsible leg assembly is in the collapsed position, the first articulating support bracket assembly is folded against the first end portion of the tabletop, one leg of the first pair of legs is disposed against the first side portion of the lower surface of the tabletop, and another leg of the first pair of legs is disposed against the second side portion of the lower surface of the tabletop; and a second collapsible leg assembly that is operable to move between a collapsed position in which the second collapsible leg assembly is disposed against the lower surface of the tabletop and an extended position in which the second collapsible leg assembly extends outward from the lower surface of the tabletop, the second collapsible leg assembly comprising:

a second attachment bar secured to the lower surface of the tabletop within the central portion;

a second cross tube rotatably attached to the lower surface of the tabletop and disposed adjacent and parallel to the second end perimeter portion;

a second pair of legs attached to and extending from the second cross tube;

a second articulated support bracket assembly having a first end rotatably attached to the second pair of legs and a second end rotatably attached to the second attachment bar, wherein, when the second collapsible leg assembly is in the collapsed position, the second articulating support bracket assembly folds against the second end portion of the tabletop, one leg of the second pair of legs is disposed against the first side portion of the lower surface of the tabletop, and another leg of the second pair of legs is disposed against the second side portion of the lower surface of the tabletop.

2. The cooler table of claim 1 further comprising:

two or more first retainer clips that are integrally molded into the lower surface of the tabletop for rotatably securing the first cross tube to the lower surface of the tabletop between the first end perimeter portion and the first end portion; and two or more second retainer clips that are integrally molded into the lower surface of the tabletop for rotatably securing the second cross tube to the lower surface of the tabletop between the second end perimeter portion and the second end portion.

3. The cooler table of claim 2 wherein:

each of the first retainer clips comprises a first section disposed within the first end perimeter portion, and a second section disposed within the first end portion; and each of the second retainer clips comprises a first section disposed within the second end perimeter portion, and a second section disposed within the second end portion.

4. The cooler table of claim 2 further comprising:

a plurality of first end perimeter depressions in the lower surface of the tabletop distributed along the first end perimeter portion, the first end perimeter depressions configured to provide structural support between the lower surface of the tabletop and the upper surface of the tabletop, wherein at least a portion of each of the two or more first retainer clips is disposed between two of the first end perimeter depressions;

a plurality of second end perimeter depressions in the lower surface of the tabletop distributed along the second end perimeter portion, the second end perimeter depressions configured to provide structural support between the lower surface of the tabletop and the upper surface of the tabletop, wherein at least a portion of each of the two or more second retainer clips is disposed between two of the second end perimeter depressions.

5. The cooler table of claim 1 further comprising an integrally molded tubular section that extends through the tabletop to fluidly connect the upper and lower drain apertures, so that liquid can enter the upper drain aperture, flow through the tubular section, and exit the lower drain aperture.

6. The cooler table of claim 1 further comprising:

a plurality of first end depressions formed in the first end portion of the lower surface of the tabletop that provide structural support between the lower surface and the upper surface of the tabletop, wherein each of the first end depressions occupies an area A1 in the lower surface and has a height H1 measured between the lower surface and the upper surface of the tabletop;

a plurality of second end depressions formed in the second end portion of the lower surface of the tabletop that provide structural support between the lower surface and the upper surface of the tabletop, wherein each of the second end depressions occupies the area A1 in the lower surface and has the height H1 measured between the lower surface and the upper surface of the tabletop;

a plurality of first side depressions formed in the first side portion of the lower surface of the tabletop that provide structural support between the lower surface and the upper surface of the tabletop, wherein each of the first side depressions occupies an area A2 in the lower surface and has a height H2 measured between the lower surface and the upper surface of the tabletop; and a plurality of second side depressions formed in the second side portion of the lower surface of the tabletop that provide structural support between the lower surface and the upper surface of the tabletop, wherein each of the second side depressions occupies the area A2 in the lower surface and has the height H2 measured between the lower surface and the upper surface of the tabletop, wherein the area A1 is greater than the area A2, and the height H1 is greater than the height H2.

7. The cooler table of claim 1 wherein the first and second side portions of the lower surface of the tabletop are each sufficiently wide to accommodate the first pair of legs and the second pair of legs in a side-by-side arrangement.

8. A cooler table comprising:

a blow-molded tabletop comprising:

an upper surface having outer edges and an upper drain aperture centrally disposed between the outer edges, wherein the upper surface slopes downward from the outer edges toward the upper drain aperture to accommodate flow of liquid from the outer edges toward the upper drain aperture;

a perimeter lip having:

inner walls extending upward from the outer edges of the upper surface of the tabletop; and outer walls spaced apart from the inner walls, the outer walls comprising a first side outer wall, a second side outer wall, a first end outer wall, and a second end outer wall;

a lower surface disposed below the upper surface and spanning between the outer walls of the perimeter lip, wherein the lower surface is spaced apart from the upper surface by a distance, the lower surface comprising:

an outer perimeter portion disposed adjacent to the outer walls of the perimeter lip, the outer perimeter portion including:

a first side perimeter portion disposed adjacent to the first side outer wall of the perimeter lip;

a second side perimeter portion disposed adjacent to the second side outer wall of the perimeter lip;

a first end perimeter portion disposed adjacent to the first end outer wall of the perimeter lip; and a second end perimeter portion disposed adjacent to the second end outer wall of the perimeter lip;

a central portion disposed between the first and second side perimeter portions and between the first and second end perimeter portions, the central portion having a lower drain aperture that is aligned with the upper drain aperture;

a first end portion disposed between the central portion and the first end perimeter portion, wherein the first end portion includes a plurality of first end depressions formed in the lower surface of the tabletop that provide structural support between the lower surface and the upper surface of the tabletop, wherein each of the first end depressions occupies an area A1 in the lower surface and has a height H1 measured between the lower surface and the upper surface;

a second end portion disposed between the central portion and the second end perimeter portion, wherein the second end portion includes a plurality of second end depressions formed in the lower surface of the tabletop that provide structural support between the lower surface and the upper surface of the tabletop, wherein each of the second end depressions occupies the area A1 in the lower surface and has the height H1 measured between the lower surface and the upper surface;

a first side portion disposed between the central portion and the first side perimeter portion, wherein the first side portion includes a plurality of first side depressions formed in the lower surface of the tabletop that provide structural support between the lower surface and the upper surface of the tabletop, wherein each of the first side depressions occupies an area A2 in the lower surface and has a height H2 measured between the lower surface and the upper surface;

a second side portion disposed between the central portion and the second side perimeter portion, wherein the second side portion includes a plurality of second side depressions formed in the lower surface of the tabletop that provide structural support between the lower surface and the upper surface of the tabletop, wherein each of the second side depressions occupies the area A2 in the lower surface and has the height H2 measured between the lower surface and the upper surface;

a first stepped transition in the distance between the upper surface and the lower surface where the central portion meets the first end portion;

a second stepped transition in the distance between the upper surface and the lower surface where the central portion meets the second end portion;

a third stepped transition in the distance between the upper surface and the lower surface where the central portion meets the first side portion; and a fourth stepped transition in the distance between the upper surface and the lower surface where the central portion meets the second side portion, wherein the area A1 is greater than the area A2, and the height H1 is greater than the height H2;

a first collapsible leg assembly that is operable to move between a collapsed position in which the first collapsible leg assembly is disposed against the lower surface of the tabletop and an extended position in which the first collapsible leg assembly extends outward from the lower surface of the tabletop, the first collapsible leg assembly comprising:

a first attachment bar secured to the lower surface of the tabletop within the central portion;

a first cross tube rotatably attached to the lower surface of the tabletop and disposed adjacent and parallel to the first end perimeter portion;

a first pair of legs attached to and extending from the first cross tube;

a first articulated support bracket assembly having a first end rotatably attached to the first pair of legs and a second end rotatably attached to the first attachment bar, wherein, when the first collapsible leg assembly is in the collapsed position, the first articulating support bracket assembly is folded against the first end portion of the tabletop, one leg of the first pair of legs is disposed against the first side portion of the lower surface of the tabletop, and another leg of the first pair of legs is disposed against the second side portion of the lower surface of the tabletop; and a second collapsible leg assembly that is operable to move between a collapsed position in which the second collapsible leg assembly is disposed against the lower surface of the tabletop and an extended position in which the second collapsible leg assembly extends outward from the lower surface of the tabletop, the second collapsible leg assembly comprising:

a second attachment bar secured to the lower surface of the tabletop within the central portion;

a second cross tube rotatably attached to the lower surface of the tabletop and disposed adjacent and parallel to the second end perimeter portion;

a second pair of legs attached to and extending from the second cross tube;

a second articulated support bracket assembly having a first end rotatably attached to the second pair of legs and a second end rotatably attached to the second attachment bar, wherein, when the second collapsible leg assembly is in the collapsed position, the second articulating support bracket assembly folds against the second end portion of the tabletop, one leg of the second pair of legs is disposed against the first side portion of the lower surface of the tabletop, and another leg of the second pair of legs is disposed against the second side portion of the lower surface of the tabletop.

9. The cooler table of claim 8 further comprising:

two or more first retainer clips that are integrally molded into the lower surface of the tabletop for rotatably securing the first cross tube to the lower surface of the tabletop between the first end perimeter portion and the first end portion; and two or more second retainer clips that are integrally molded into the lower surface of the tabletop for rotatably securing the second cross tube to the lower surface of the tabletop between the second end perimeter portion and the second end portion.

10. The cooler table of claim 9 wherein:

each of the first retainer clips comprises a first section disposed within the first end perimeter portion, and a second section disposed within the first end portion; and each of the second retainer clips comprises a first section disposed within the second end perimeter portion, and a second section disposed within the second end portion.

11. The cooler table of claim 9 further comprising:

a plurality of first end perimeter depressions in the lower surface of the tabletop distributed along the first end perimeter portion, the first end perimeter depressions configured to provide structural support between the lower surface of the tabletop and the upper surface of the tabletop, wherein at least a portion of each of the two or more first retainer clips is disposed between two of the first end perimeter depressions;

a plurality of second end perimeter depressions in the lower surface of the tabletop distributed along the second end perimeter portion, the second end perimeter depressions configured to provide structural support between the lower surface of the tabletop and the upper surface of the tabletop, wherein at least a portion of each of the two or more second retainer clips is disposed between two of the second end perimeter depressions.

12. The cooler table of claim 8 further comprising an integrally molded tubular section that extends through the tabletop to fluidly connect the upper and lower drain apertures, so that liquid can enter the upper drain aperture, flow through the tubular section, and exit the lower drain aperture.

* * * * *